US010894994B2

(12) United States Patent
Böcher et al.

(10) Patent No.: US 10,894,994 B2
(45) Date of Patent: Jan. 19, 2021

(54) METHOD FOR PRODUCING A METAL PRODUCT

(71) Applicant: SMS group GmbH, Düsseldorf (DE)

(72) Inventors: Tilmann Böcher, Düsseldorf (DE); Marcel van Reimersdahl, Düsseldorf (DE); Luc Neumann, Düsseldorf (DE); Uwe Plociennik, Ratingen (DE)

(73) Assignee: SMS group GmbH, Düsseldorf (DE)

( * ) Notice: Subject to any disclaimer, the term of this patent is extended or adjusted under 35 U.S.C. 154(b) by 626 days.

(21) Appl. No.: 15/328,234

(22) PCT Filed: Jun. 1, 2015

(86) PCT No.: PCT/EP2015/062060
§ 371 (c)(1),
(2) Date: Jan. 23, 2017

(87) PCT Pub. No.: WO2016/012131
PCT Pub. Date: Jan. 28, 2016

(65) Prior Publication Data

US 2017/0211162 A1 Jul. 27, 2017

(30) Foreign Application Priority Data

Jul. 23, 2014 (DE) ..... 10 2014 214 374

(51) Int. Cl.
*C21D 9/00* (2006.01)
*C21D 8/02* (2006.01)
(Continued)

(52) U.S. Cl.
CPC ..... *C21D 9/0081* (2013.01); *B22D 11/041* (2013.01); *B22D 11/124* (2013.01);
(Continued)

(58) Field of Classification Search
CPC ..... C21D 9/0081; C21D 8/021; C21D 2211/005; C21D 2211/001; B22D 11/041;
(Continued)

(56) References Cited

U.S. PATENT DOCUMENTS 6,835,253 B1 * 12/2004 Kawalla ..... B21B 1/46 148/541
2009/0095438 A1 * 4/2009 Plociennik ..... B22D 11/225 164/462

FOREIGN PATENT DOCUMENTS

DE 69431178 T2 3/2003
DE 102006056683 A1 7/2007
(Continued)

OTHER PUBLICATIONS

International Preliminary Report on Patentability dated Oct. 13, 2016 in corresponding Application No. PCT/EP2015/062060; 17 pgs.

(Continued)

*Primary Examiner* — Jophy S. Koshy
(74) *Attorney, Agent, or Firm* — Maier & Maier, PLLC

(57) ABSTRACT

A method for producing a metal product, wherein in a strand casting system, liquid metal is output as a slab from a mold vertically downward in a conveying direction, is guided along a strand guide, and is deflected into the horizontal, wherein the slab is heated in a furnace or inductively downstream of the stand casting system.

4 Claims, 4 Drawing Sheets

(51) Int. Cl.

| | |
|---|---|
| ***B22D 11/041*** | (2006.01) |
| ***B22D 11/12*** | (2006.01) |
| ***B22D 11/124*** | (2006.01) |
| ***B22D 11/22*** | (2006.01) |

(52) U.S. Cl.
CPC ..... *B22D 11/1213* (2013.01); *B22D 11/225* (2013.01); *C21D 8/021* (2013.01); *C21D 2211/001* (2013.01); *C21D 2211/005* (2013.01)

(58) Field of Classification Search
CPC .. B22D 11/225; B22D 11/124; B22D 11/1213
See application file for complete search history.

(56) References Cited

FOREIGN PATENT DOCUMENTS

| | | | | | |
|---|---|---|---|---|---|
| DE | 102009048567 | A1 | | 5/2010 | |
| EP | 0686702 | A1 | | 12/1995 | |
| EP | 1937429 | A1 | * | 7/2008 | ..... B22D 11/225 |
| EP | 1937429 | B1 | | 7/2008 | |
| JP | S55-14173 | A | | 1/1980 | |
| JP | S63-112058 | A | | 5/1988 | |
| JP | H107197120 | A | | 8/1995 | |
| JP | 2002-307148 | A | | 10/2002 | |
| JP | 2007-245232 | A | | 9/2007 | |
| JP | 2011224649 | A | * | 11/2011 | |
| WO | 2010/003402 | A1 | | 1/2010 | |

OTHER PUBLICATIONS

International Search Report dated Aug. 13, 2015 in corresponding Application No. PCT/EP2015/062060; 14 pgs.

* cited by examiner

METHOD FOR PRODUCING A METAL PRODUCT

The invention relates to a method for producing a metallic product, for which liquid metal is discharged vertically downwards in the conveying direction from a mold in a strand casting system as a slab, guided along a strand guide and diverted into the horizontal direction, wherein the slab downstream from the strand casting system is heated in a furnace.

When steel with higher contents of copper and tin is cast, there are surface defects, the so-called copper-red or hot-shortness. It is well known that the surface quality can be improved with grain refining by using the means of a structural conversion of austenite into ferrite and back to austenite, with the result that fewer surface cracks, which are not as deep, occur on the slab, or on the thin slab or the warmband.

Figure 1:
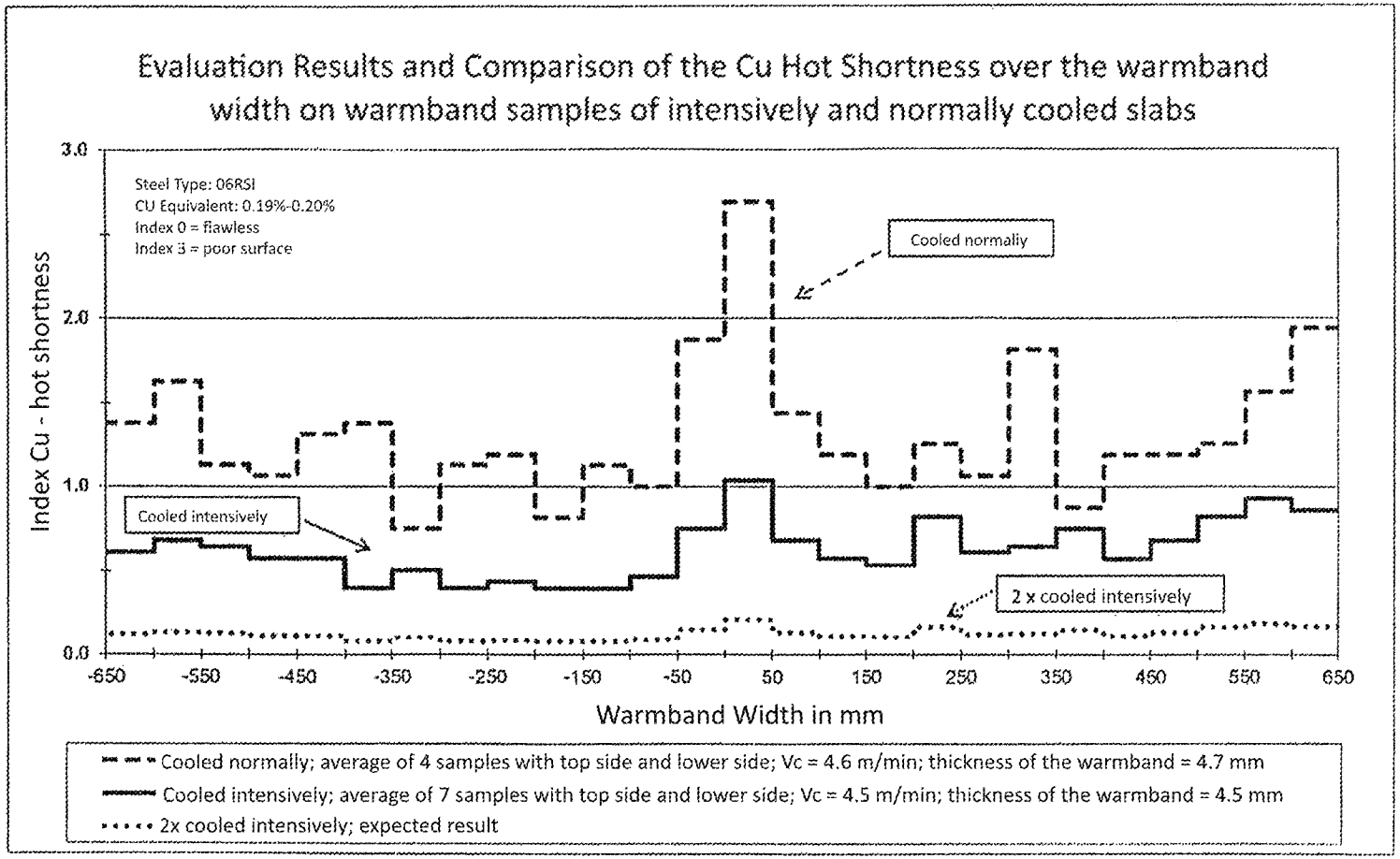

On the surface, however, there are still isolated cracks ("hot shortness"). The cause of this is that, in spite of the structural conversion, there is still a partially coarse, inhomogeneous structure. This was confirmed in experiments in which intensive cooling was applied in the upper strand guide. Sandblasted warmband samples from warmbands, the corresponding slabs of which had been cooled intensively and normally, were visually evaluated by means of a series of directives with respect to the surface defects over the width of the hot strip. This is illustrated in FIG. 1. An experiment on a so-called CSP strand casting system is shown with intensively and normally cooled slabs; the average values of the inspected warmband samples are shown, wherein "0" stands defect-free and "3" stands for the worst surface.

On the one hand, it is clear from the illustration in FIG. 1 that the intensive cooling of the slab generally reduces the occurrence of copper hot shortness. On the other hand, there are variations in the incidence of "hot shortness" over the width of the hot strip. This is because the structure near the surface is not homogeneous. The coarser the structure near the surface, the greater is the incidence of "hot shortness" because there are fewer grain boundaries for the penetration of the copper-containing phase.

Repeated, two-fold intensive cooling causes a further refinement and homogenization of the surface structure. Accordingly, the surface result with respect to hot shortness will be improved further. The improved surface finish, which is to be expected, is also shown in FIG. 1.

For the processing of steel, reference may be made to JP 2002 307 148 A, to DE 694 31 178 T2, to WO 2010/003402 A1, to DE 10 2009 048 567 A1, to EP 1 937 429 B1 and to EP 0 686 702 A1.

The invention is based on the object of providing a method, which makes it possible to further decrease in surface cracks and, and with that also makes an improvement in the surface quality possible. A very fine and homogeneous structure is thus to be achieved in the material.

The solution of this object by the invention is characterized in that the method comprises the steps of:

a) intensively cooling the slab behind the mold in the conveying direction in a first cooling zone in such a way, that a structural conversion of austenite into ferrite takes place in the edge region of the slab near the surface;

b) reheating of the slab in a first heating zone downstream from the first cooling zone in the conveying direction in such a way, that structural conversion from ferrite to austenite takes place in the edge zone of the slab near the surface;

c) intensively cooling the slab in a second cooling zone downstream from the first heating zone in the conveying direction takes place in such a way that a structural conversion of austenite into ferrite occurs in the edge region of the slab near the surface;

d) downstream from the second cooling zone in the conveying direction in a second heating zone: reheating the slab in such a way, that a conversion of the ferrite into austenite takes place in the edge zone of the slab near the surface.

After step d) is carried out, at least one further intensive cooling of the slab can take place in such a way, that a structural transformation of austenite into ferrite takes place in the surface-near edge zone of the slab near the surface.

Furthermore, after said further intensive cooling of the slab is carried out, at least one further heating of the slab can still take place in such a manner that structure conversion from ferrite to austenite takes place in the edge zone of the slab near the surface.

At least one of the reheatings of the slab can be effected by heat equalization in the slab by permitting heat to flow from the interior of the slab to the surface.

The last heating of the slab can also take place in the furnace and/or by inductive heating.

In the case of steps a) and c) above, the slab surface is cooled preferably to a temperature below the Ac1 temperature. Correspondingly, the temperature of the slab surface in steps b) and d) is raised preferably to one above the Ac3 temperature.

The last intensive cooling of the slab takes place according to a possible embodiment of the invention as soon as the slab has been diverted into the horizontal position.

The above steps a) to c) can also be carried out while the slab is still oriented in the vertical direction.

The above step b) may also take place as soon as the slab has left the vertical position.

The invention thus aims at a multiple structural conversion near the surface in the strand casting system in order to improve the surface quality of the slab.

The structural conversion of austenite to ferrite, back to austenite and once again to ferrite, etc., is repeated several times in the edge zone of the slab near the surface. This results in a refinement of the partially coarse, inhomogeneous structure and in a further decrease in surface cracks and thus to an improvement in the surface quality. This corresponds to a pendular tempering or multiple normalization during the heat treatment. In order to achieve the desired homogeneous grain refinement, the transformation must be carried out at least twice.

A possible embodiment of the method may also be such that a first passage of the conversion from austenite to ferrite and, furthermore, to austenite in the area of the slab near the surface takes place by intensive cooling in the upper region of the strand guide of the continuous casting line, followed by a reheating of the area of the slab near the surface by normal or weak cooling in the middle region of the strand guide.

A second passage of the conversion of austenite to ferrite and further to austenite can be effected by renewed intensive cooling and subsequent reheating.

If desired, a third or second passage of the conversion of austenite to ferrite and further to austenite may occur before or after the straightening driver.

According to the invention, the slab is subjected to a multi-stage heat treatment after leaving the mold within the strand guide of the continuous casting line or downstream from the shears or before entering the tunnel kiln or in the furnace, with the objective of configuring the structure in the edge zone near the surface to be fine and homogeneous.

After exiting the mold, the already solidified strand shell, as a rule, has an austenitic, inhomogeneous solidification structure, which depends on the composition of the steel. Due to a time-defined, intense cooling, the edge zone of the steel strand near the surface is cooled below the mold to a temperature below the Ac1 point, so that a first transformation of austenite into ferrite takes place in the edge layers. By the subsequent reheating of the ferritic edge zone near the surface by the still existing core or melt heat from the inner slab to a temperature above $AC_3$, the ferrite is converted back into austenite. Both transformations are associated with a refinement of the structure.

However, inhomogeneities (partial coarseness) of the original austenitic structure may be maintained. This "inheriting" of the structural inhomogeneities can be eliminated by the repeated, that is to say a two-stage or multistage austenite-ferrite-austenite conversion, so that a fine, homogeneous austenitic structure will be ultimately present.

In the context of the present invention, the two-stage austenite-ferrite-austenite-ferrite-austenite conversion is realized, in particular, by an intensive cooling below the mold in the upper part of the strand guide of the continuous casting installation (near the surface, austenite is converted into ferrite) and by re-heating the edge layer near the surface with the core heat of the slab in the middle part of the strand guide (the ferrite near the surface is converted to austenite).

This is followed by an intensive cooling in the lower part of the strand guide (austenite, in the vicinity of the surface, is converted into ferrite) and by a reheating after exiting from the strand guide by means of the core heat (ferrite, which is near the surface, is converted into austenite) or in a downstream heating furnace.

An alternative provides that the second or a still further stage of the conversion of austenite into ferrite is realized by mounting additional chilled beams in a section on the strand guide. The required conversion of the ferrite near the surface to austenite was effected either by the core heat of the slab or in a downstream heating furnace.

Figure 2:
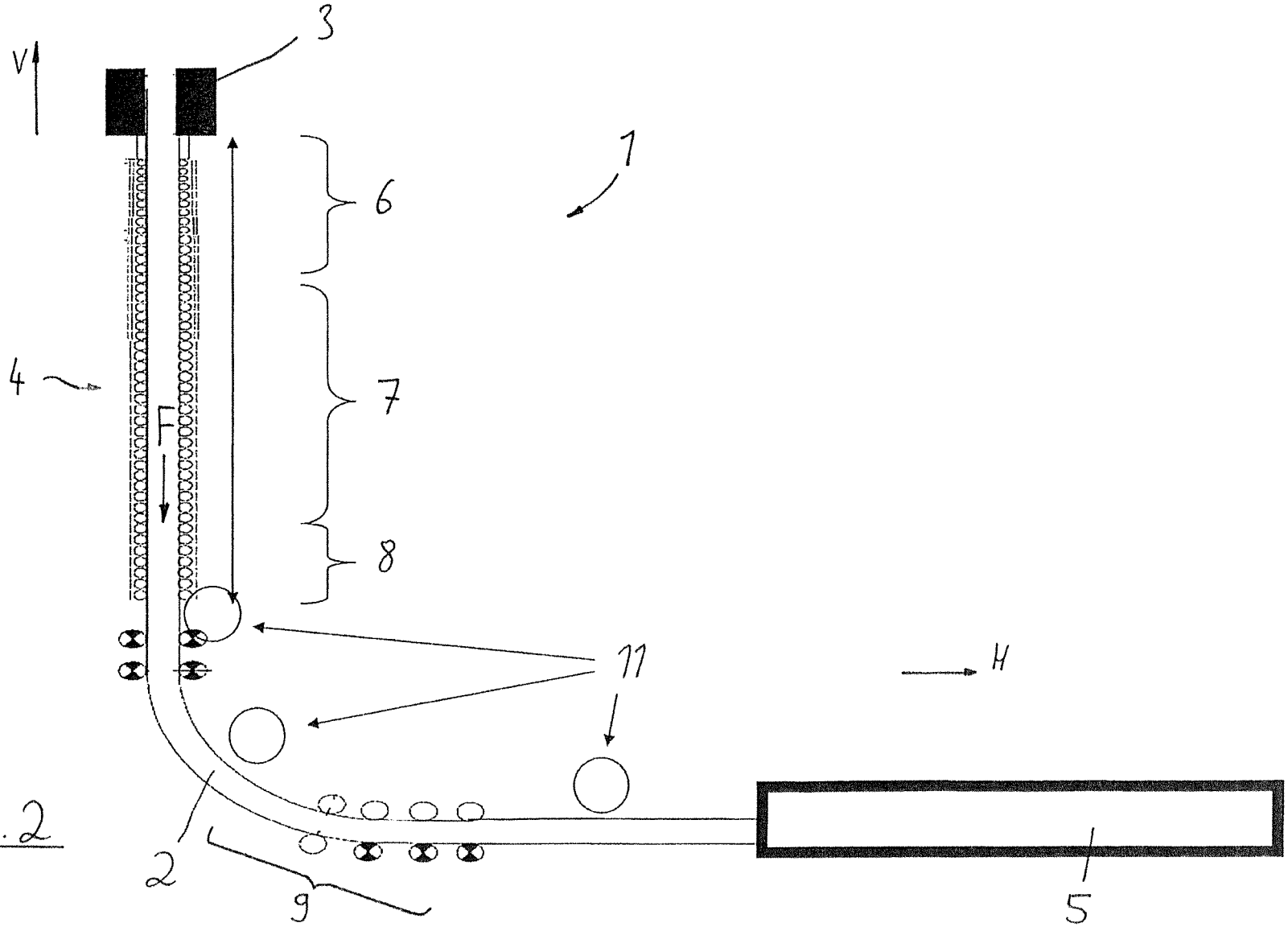
Figure 3:
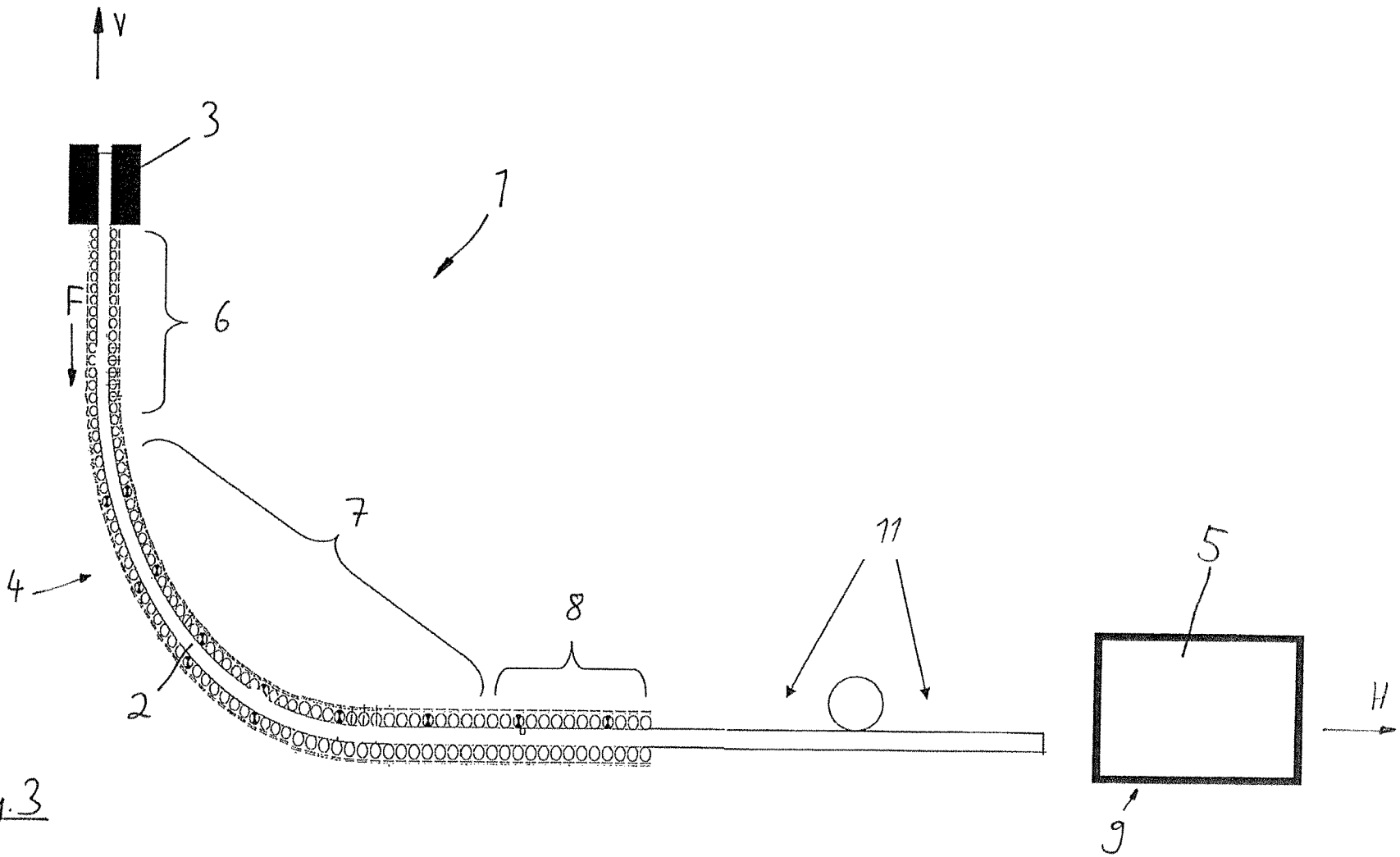
Figure 4:
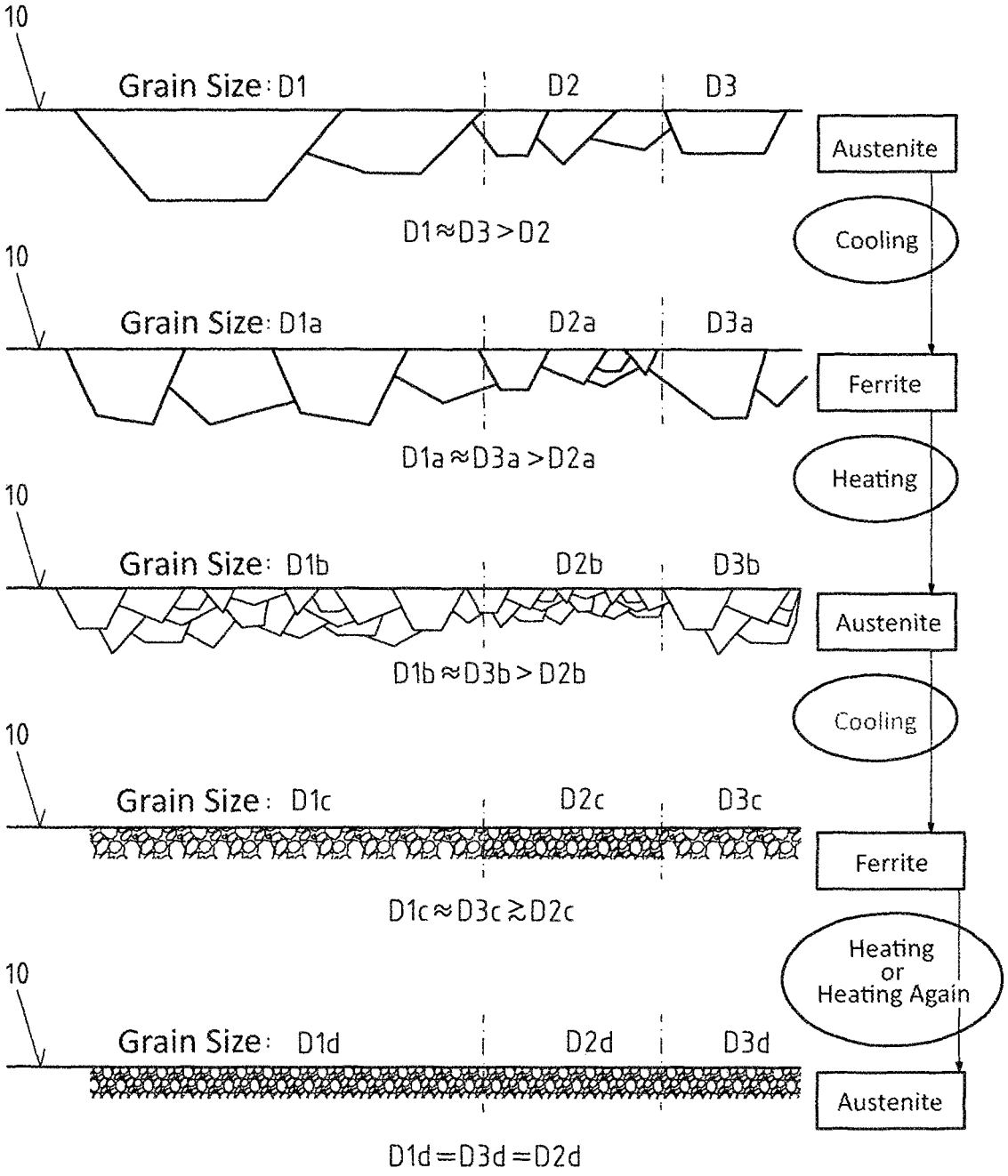

Examples of the invention are shown in the drawings, which show the following:

FIG. 1 shows the evaluation of the result of the copper hot shortness of a steel strip over the width of the hot strip for different degrees of intensity of the cooling, FIG. 2 shows a diagram indicating continuous casting installation with an illustration of a first embodiment of the invention, FIG. 3 shows a diagram indicating continuous casting installation with an illustration of a second embodiment of the invention and FIG. 4 shows a diagram of a representation of the structure formation in an edge zone of a slab near the surface during an inventive method.

The present invention relates to a method that is carried out in a continuous casting installation for steel. Conventional slabs, thin slabs or slabs with a medium thickness can be produced.

A first example of the invention can be seen in FIG. 2. The strand casting system 1 has a mold 3, below which is disposed a strand guide 4. The cast slab 2 is deflected by the vertical guide V into the horizontal plane H by means of the strand guide 4 or the downstream rollers. The slab 2 is thereby conveyed in a feed direction F. After the slab 2 is deflected into the horizontal direction H, it is conveyed into a furnace 5.

It is essential that intensive cooling of the slab 2 takes place behind the mold 3 in the conveying direction F (that is, directly below the mold 3), in a first cooling zone 6. For this purpose, an appropriate volume of water is sprayed onto the surface of the slab. The cooling takes place at such an intensity that the structure of austenite is converted into that of ferrite in the edge zone of the slab 2 near the surface.

The slab subsequently reaches a first heating zone 6, which, in the conveying direction, is disposed behind the first cooling zone 6. Reheating of the slab 2 takes place in such a way that a conversion of the structure of the ferrite back into the structure of austenite takes place in the edge zone of the slab 2 near the surface. In the heating zone 7, there is normal or weak cooling, so that the said structural conversion can take place.

In the conveying direction F of the first heating zone 7, there is a second cooling zone 8. Once again an intensive cooling of the slab 2 takes place in such a way that a structural conversion of austenite to ferrite takes place in the edge zone of the slab 2 near the surface.

Finally, downstream from the second cooling zone 8 in the conveying direction F, a second heating zone 9 follows in which the slab 2 is reheated in such a way that a structural conversion of ferrite into austenite takes place in the edge zone of the slab 2 near the surface.

The reference numeral 11 indicates that alternative positions for additional chilled beams for intensive cooling are disposed here in order to effect a conversion of austenite to ferrite In addition, it should still be mentioned in connection with furnace 5 that a conversion of ferrite to austenite may take place also here, if appropriate warming takes place.

FIG. 2 shows that the strand casting system 1 is designed as a perpendicular bending installation, wherein the bending of the slab from the vertical into the horizontal position takes place in the case of a solid slab core.

As shown in FIG. 3, an alternative embodiment of the invention provides that a strand casting system 1 is used as the vertical bending installation, wherein the bending is carried out with a liquid slab core.

The indicated reference symbols correspond to those of FIG. 2. The first heating zone 7 lies precisely where the slab leaves the vertical V and it is bent around. The furnace 5 is provided as a second heating zone 9.

The diagram indicated in FIG. 4 shows how the structure is changed when the respective changes from austenite to ferrite and back take place.

The slab surface 10 is indicated and the structure in the area of the slab near the surface is sketched. The respective grain diameters are shown diagrammatically here and placed in relation to one another. The last letters for the grain diameters D for three adjacent regions 1, 2 and 3 over the width of the slab indicate the respective status after the corresponding structural conversions.

It can be seen that, from phase conversion to phase conversion, the grain size not only becomes smaller, but also uniform.

In the case of slabs, the grain diameters are in accordance with the ASTM grain size Table of ASTM Nos. −3 to 0.

The following grain sizes are achieved by the conversion:

D 1, 2, 3a: ASTM No. 0 through 2,

D 1, 2, 3b: ASTM No. 2 through 4,

D 1, 2, 3c: ASTM No. 4 through 6,

D 1, 2, 3d: ASTM No. 6 through 7.

ASTM: American Society for Testing and Material

LIST OF REFERENCE SYMBOLS

1 strand casting system

2 slab

3 mold
4 strand guide
5 furnace/inductive heating
6 first cooling zone
7 first heating zone
8 second cooling zone
9 second heating zone
10 slab surface
11 chilled beam
V vertical position
H horizontal position
F conveying direction

The invention claimed is:

1. A method for producing a steel product, for which liquid metal is discharged from a mold in a strand casting system as a slab vertically downwards in a conveying direction, guided along a strand guide and diverted into a horizontal direction, the slab being heated in a furnace downstream from strand casting system, wherein the method comprises the steps of:

a) her the conveying direction behind the mold in a first cooling zone: cooling of the slab takes place in such a way, that a structural conversion from austenite to ferrite occurs near a surface of the slab;

b) downstream from the first cooling zone in the conveying direction in a first heating zone: reheating the slab in such a way that a structure conversion from ferrite into austenite takes place near the surface of the slab, the reheating of the slab takes place due to heat equalization in the slab by permitting heat to flow from the interior of the slab to the surface of the slab;

c) in the conveying direction behind the first heating zone in a second cooling zone: cooling of the slab in such a way, that a structural conversion of austenite into ferrite takes place near the surface of the slab;

wherein the steps a) to c) are carried out while the slab is still oriented in the vertical direction, and d) downstream from the second cooling zone in the conveying direction, in a second heating zone: reheating of the slab in such a way, that structural conversion from ferrite into austenite takes place near the surface of the slab, the slab being heated in the furnace or by inductive heating, wherein, if the slab is heated by inductive heating in the second heating zone, the slab is heated in the furnace in a subsequent heating zone further downstream;

wherein at least one further cooling of the slab is carried out after the implementation of step d) in such a way, that a structural transformation of austenite into ferrite occurs near the surface of the slab, wherein, after the implementation of the at least one further cooling of the slab, there is at least one further heating of the slab in such a manner, that the ferrite structure is converted into the austenite structure near the surface of the slab, and wherein chilled beams for cooling are disposed before after the second heating zone and are configured to effect a conversion of austenite to ferrite.

2. The method of claim 1, wherein the surface of the slab is cooled in steps a) and c) of claim 1, to a temperature below the Ac1 temperature.

3. The method of claim 1, wherein the surface of the slab is heated in steps b) and d) of claim 1 to a temperature above the Ac3 temperature.

4. The method of claim 1, wherein the at least one further cooling of the slab takes place as soon as the slab is diverted into the horizontal direction.

* * * * *